US005476228A

United States Patent [19]

Underberg

[11] Patent Number: 5,476,228

[45] Date of Patent: Dec. 19, 1995

[54] REFINER DISK WITH ALTERNATING DEPTH GROOVES

[75] Inventor: Wesley Underberg, Glendale, Wis.

[73] Assignee: Beloit Technologies, Inc., Wilmington, Del.

[21] Appl. No.: 206,815

[22] Filed: Mar. 7, 1994

[51] Int. Cl.[6] ..... B02C 7/12

[52] U.S. Cl. ..... 241/296; 241/261.2

[58] Field of Search ..... 241/261.2, 261.3, 241/296, 298

[56] References Cited

U.S. PATENT DOCUMENTS

| | | | |
|---|---|---|---|
| 104,107 | 6/1870 | Bowman | 241/296 |
| 1,696,514 | 12/1928 | Anthony | 241/296 |
| 2,035,994 | 3/1936 | Sutherland, Jr. . | |
| 2,651,976 | 9/1953 | Sutherland | 241/296 |
| 3,387,796 | 6/1968 | Cormack et al. | 241/261.3 X |
| 3,910,511 | 10/1975 | Leider et al. | 241/298 X |
| 4,039,154 | 8/1977 | Peterson . | |
| 4,676,440 | 6/1987 | Perkola . | |
| 4,712,745 | 12/1987 | Leith | 241/261.3 |
| 5,046,672 | 9/1991 | Demler et al. . | |

FOREIGN PATENT DOCUMENTS

| | | | |
|---|---|---|---|
| 2303898 | 3/1976 | France . | |
| 2394638 | 6/1977 | France . | |
| 654360 | 12/1937 | Germany | 241/296 |
| 7573 | of 1911 | United Kingdom | 241/296 |
| 8806490 | 9/1988 | WIPO | 241/261.3 |

*Primary Examiner*—Timothy V. Eley

*Attorney, Agent, or Firm*—Dirk J. Veneman; Raymond W. Campbell

[57] ABSTRACT

A disk especially suitable for a papermaking wood chip and pulp refiner has an array of refiner bars which protrude outwardly from a base member. Grooves are formed between adjacent bars which may change in depth toward the outer diameter of the disk. Alternating grooves are of greater depth, to increase the open area of the disk to facilitate steam evacuation without significantly reducing the bar stiffness and hence resistance to breakage and deflection of individual bars.

2 Claims, 3 Drawing Sheets

REFINER DISK WITH ALTERNATING DEPTH GROOVES

FIELD OF THE INVENTION

This invention relates to refiners which treat paper pulp fibers in general and to disk refiners in particular.

BACKGROUND OF THE INVENTION

During the production of fibers for papermaking, wood or other fiber source material is ground and/or mechanically treated such that the material may be broken down further and refined into individual fibers.

High consistency disk refiners are used with stock containing eighteen to sixty percent fiber by weight. High consistency refiners are used to produce mechanical and semichemical pulp or furnish from undigested wood chips and semidigested wood chips. The refiner breaks down wood chips and clumps of wood fibers into individual fibers from which paper may be formed. After processing in a high consistency refiner, the fibers may be further processed in, for example, a low consistency refiner to improve their freeness or bonding capability.

A refiner disk consists of a disk-shaped steel or steel-alloy casting which has a multiplicity of generally radially extending bars integrally cast with and as a part of the surface of the disk. A first refiner disk is mounted on a rotor for rotation and another disk is held opposed to the first refiner disk, either by rigid mounting or by mounting on an opposite rotating rotor. The refiner disks, as they move past each other, separate and refine the wood pulp as it passes between the opposed disks.

When dealing with high consistency pulp and wood chips, the edges of the refiner bar act as cutting edges for separating fibers from wood chips or clumps of fibers and for splitting open individual fibers.

Disk refiners are used in the paper manufacturing industry to prepare the cellulose fibers of a paper pulp into a desired condition prior to delivering the pulp to the papermaking machine.

It is the purpose of a stock refiner to modify the fibers without significantly reducing the length or individual strength of these fibers. U.S. Pat. No. 3,880,368 to Matthew discloses the benefit of repeatedly and gently refining the pulp to ensure that fibers are not extensively damaged. Matthew points out the impracticability of avoiding all fiber damage, and suggests that gentle refining can be accomplished by the use of many blades per plate and operating at relatively high speeds. However, the use of many blades or bars on the plates reduces the flow area available for both fiber and the steam generated in high consistency refining. This can reduce the through-put, decreasing the efficiency and increasing the costs of the refining process.

Lower intensity refining has been obtained by increasing the number of refiner bars within a given disk area. However, the width of individual bars cannot be proportionately reduced, as inadequate bar strength may result. Bars which are too narrow for a given height will tend to crack or otherwise deviate from specified performance. Thus increasing the numbers of bars has come at the expense of the groove width and depth between neighboring bars. This reduced groove size mandates a reduced outer diameter open area, which causes high steam pressure and reduced loadability because of excessive back-flowing steam.

Refiner disks have been fabricated with steam exhaust channels which extend radially outwardly and cut across refining grooves between bars. These large-width channels provide not only a low-resistance path for the escape of steam generated in the refining process, but also a channel for unrefined fiber to exit the refining zone without being refined. The steam exhaust channels sacrifice a significant portion of refiner bar length, and hence result in a reduction from the optimum potential refining intensity.

What is needed is a refiner disk which provides improved steam flow while maintaining a refining action that is less damaging to individual paper fibers and provides optimum refining intensity.

SUMMARY OF THE INVENTION

The refiner disk for a disk refiner of the present invention provides improved outer diameter open area by forming grooves of greater and lesser depth between adjacent bars to achieve both acceptable bar strength and groove open area. However, because only every other groove is deeper, the bar stiffness is not significantly reduced, and hence resistance to breakage and deflection of individual bars is preserved.

It is an object of the present invention to provide a refiner disk with low intensity refining with adequate outer diameter open area to facilitate forward flow steam evacuation.

It is also an object of the present invention to provide a refiner disk with improved stock flow.

Further objects, features, and advantages of the invention will be apparent from the following detailed description when taken in conjunction with the accompanying drawings.

DESCRIPTION OF THE PREFERRED EMBODIMENT

Figure 1:
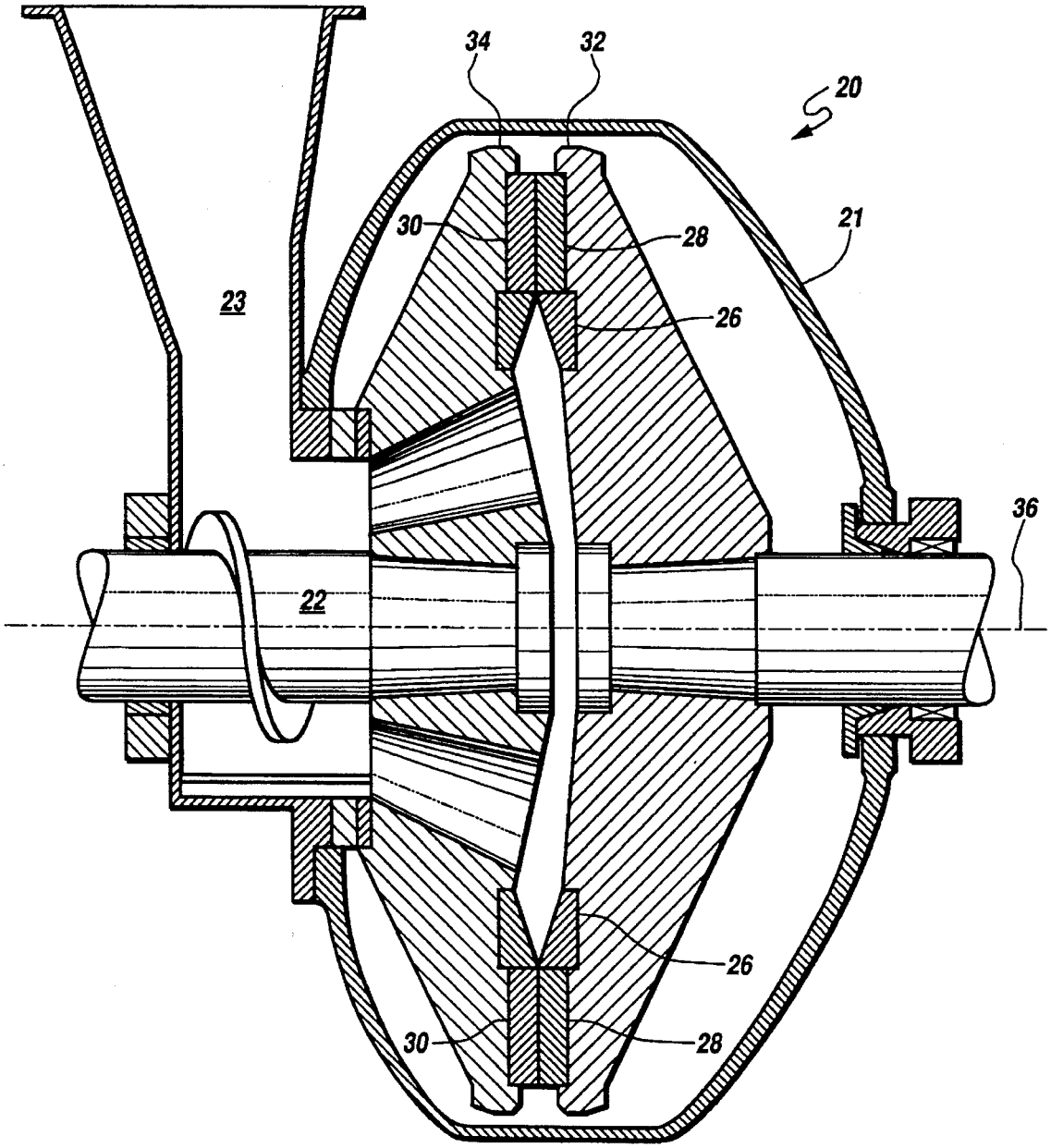
FIG. 1 is a fragmentary cross-sectional view of an exemplary high consistency stock disk refiner which may be used with the refiner disks of this invention.

Referring more particularly to FIGS. 1–7, wherein like numbers refer to similar parts, a typical high-consistency pulp refiner 20 is shown in FIG. 1. The refiner 20 has a housing 21 with a stock inlet 23 through which stock is introduced. The refiner 20 has a feeder 22 which supplies a high consistency pulp or wood chip feed consisting of eighteen to sixty percent wood chips and wood fiber suspended in liquid. The feeder 22 supplies fibers and/or wood chips to a breaker bar section 26 and hence to a refiner section comprised of a first refiner disk 28 and a second refiner disk 30. The refiner disks 28, 30 are generally annular members, typically comprised of a number of cast sectors 31. The refiner disks 28, 30 are positioned in opposed relation in the refiner and have refiner bars which face one another. One refiner disk 28 is mounted to a rotor 32, and the other refiner disk 30 is mounted to a counter-rotating rotor 34. The rotors 32, 34 and the attached refiner disks 28, 30 rotate about an axis 36.

Figure 2:
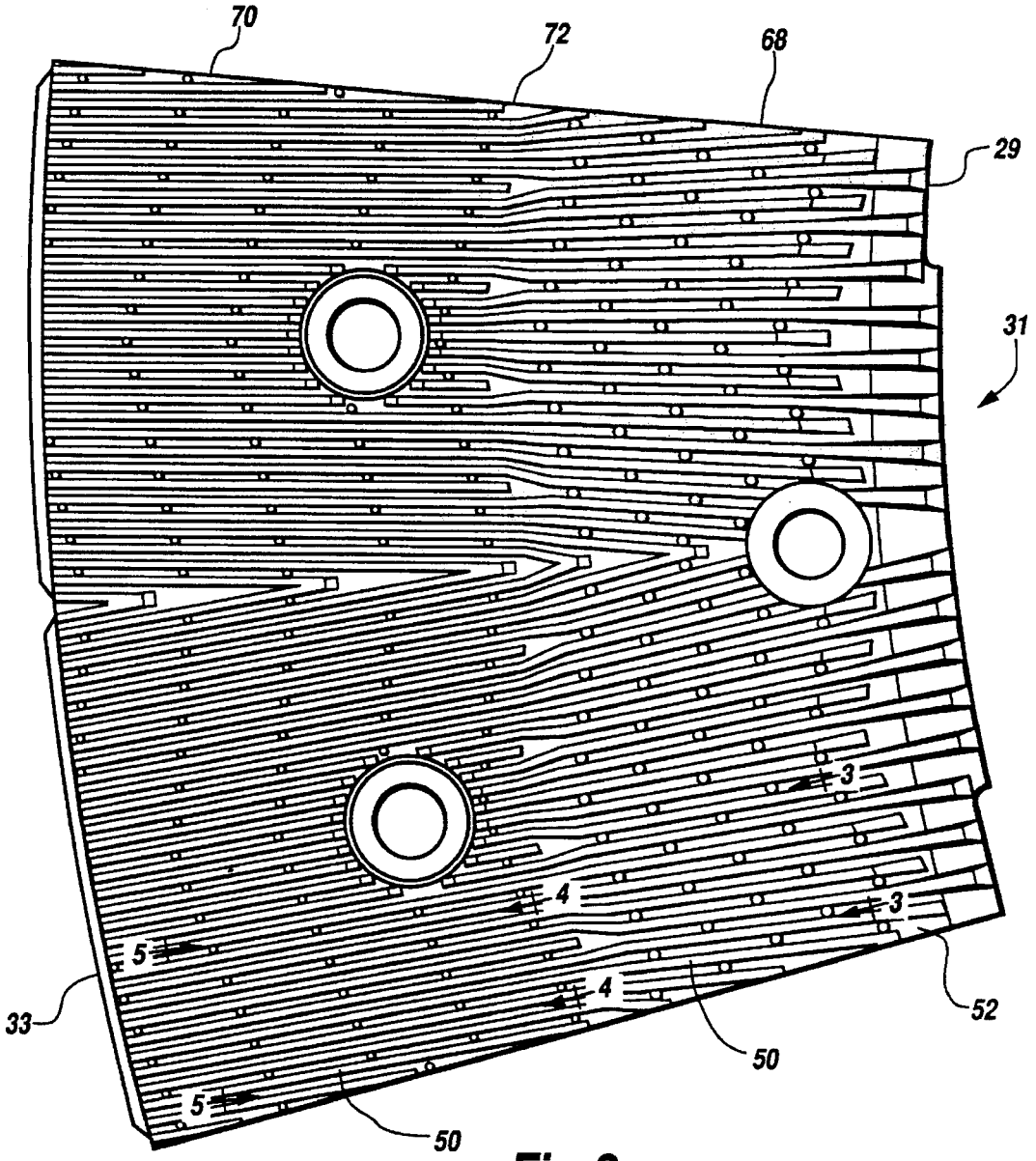
FIG. 2 is a top plan view of a refiner disk sector of a refiner disk of this invention.

Each refiner disk sector 31, shown in FIG. 2, has a multiplicity of refiner bars 50. An exemplary refiner bar 50 may be one fourteenth of an inch wide and one quarter of an inch high, with adjacent bars 50 spaced in parallel or non-parallel relation thereto. Refiner disks are typically in the range of about fourteen to sixty-eight inches in diameter and are rotated with respect to one another at rates of nine hundred to thirty-six hundred rpm. As the disks are spun about a common axis, the refiner bars of the opposed disks pass in close proximity to one another and perform the refining action on material flowing between the disks.

In operation, the gap between the refiner disks 28, 30 mounted on the rotors 32, 34 is typically 0.003 to 0.050 inches.

While each refiner disk sector 31 typically is cast as an integral unit, with bars on at least one face thereof, the sector may be viewed as having a base member or region 52, with the bars 50 protruding outwardly from a face thereof. The size, shape and angular orientation of the bars will vary, depending upon the application for which the refiner disk is used, with consideration to the material being refined, the refining conditions and the desired refining result.

The design of refiner disks requires recognition of criteria for improving the performance of the disks. The first of these design criteria is the km/rev. This criteria is a measure of the total length of cutting edges on bars on a given disk. The desirability of increasing the total length of the bars on the disk is understood in terms of the desirability of causing the abrasion of the pulp fibers with as low an intensity as possible. The power consumed by the disk refiner 20 is dissipated over the area of the refiner disks 28, 30. By increasing the length of the bars or the number of the bars, the amount of power dissipated per unit length of bar is decreased. Because power dissipation is proportional to the abrasion action, the net result of longer bar length is that the abrasion takes place over a longer period of time and is thus of lower intensity. Lower intensity results in fewer cut or damaged fibers caused by excessive abrasive action.

Another important design consideration is the amount of restriction of flow at the inside diameter and outside diameter of the refiner disk. Although a number of factors affect the openness of flow, the restriction is generally correlated with the amount of open area on the inside diameter and on the outside diameter, and with the number, location and height of dams. By open area is meant the cumulative area at a circumference at a radius of interest. Open area is important to achieve flow through the disk refiner. Because of the pressures and temperatures developed between the rapidly spinning disks, steam is generally produced at a midpoint between the inner and outer diameters. If not allowed an avenue to escape radially outwardly, the steam can urge wood fibers back toward the inner radius, hampering the throughput of fibers. Typically, the greatest steam pressure is experienced between the inner diameter 29 and the outer diameter 33 of the disk. Disks should be designed with greater open area toward the outer diameter 33 to facilitate forward flow of the steam.

In increasing the number of refiner bars on a disk, it is not generally possible to simply reduce the size of the bars. Narrower width bars may have a reduced strength which could cause the bars to fail under the pressures and stresses of active refining. Hence to increase the number of bars beyond a certain level, it is necessary to reduce the bar spacing, yielding reduced open area and an undesirable increase in steam pressure and a reduction in flow. Increasing the depths of all grooves to maintain openness is unacceptable. If the grooves on either side of a bar are deepened, the bar becomes untenably narrow with respect to its height, even if the bar width is not changed.

Figure 3:
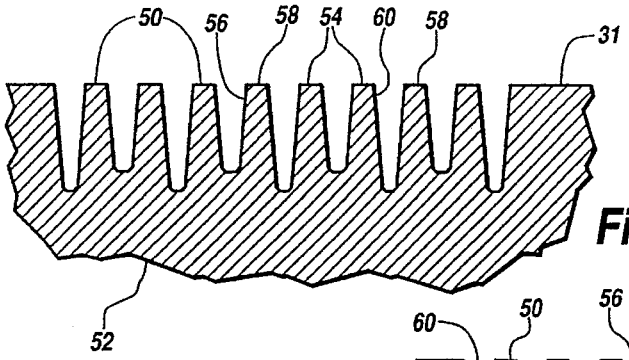
FIG. 3 is a cross-sectional view of the refiner disk of FIG. 2 taken along section line 3—3 and showing the inner diameter groove depths.
Figure 4:
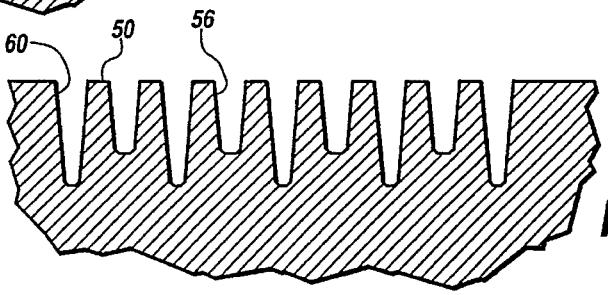
FIG. 4 is a cross-sectional view of the refiner disk of FIG. 2 taken along section line 4—4 and showing the transition groove depths.
Figure 5:
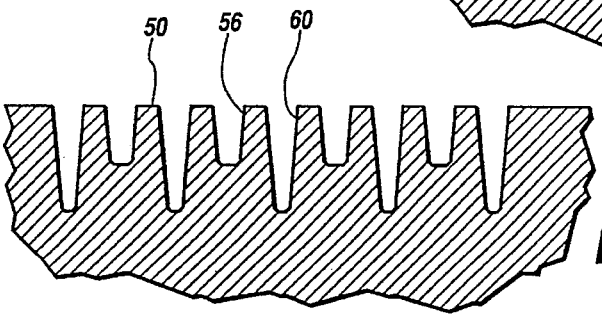
FIG. 5 is a cross-sectional view of the refiner disk of FIG. 2 taken along section line 5—5 and showing the outer diameter groove depths.

As shown in FIGS. 3–5, the disk 28 of this invention provides increased openness, while retaining necessary bar strength, by forming grooves of greater depth between alternating pairs of neighboring bars 50. The bars 50 protrude outwardly from a face of the base member 52. Two first refiner bars 54 are spaced from one another and define a shallow groove 56 therebetween. Second refiner bars 58 are spaced on either side of the first bars and define two deep grooves 60 with the first bars. The result of alternating the depth of the grooves along the array of bars is that two deep grooves never define a single bar, and hence bars of unacceptable narrowness for their height are never formed.

Figure 6:
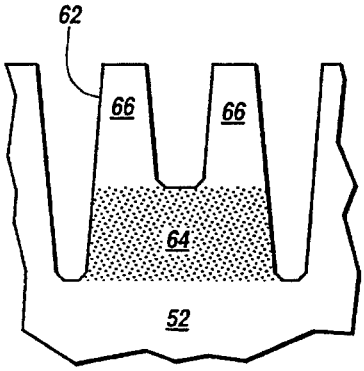
FIG. 6 is a diagrammatic view of a single two-bar structure of the refiner disk of FIG. 2.

The acceptably stiff structure of the bars 54, 58 may be conceptualized by considering the two-bar structure 62 which extends from the base member 52 between two deep grooves 60. As shown in FIG. 6, each two-bar structure 62 is comprised of a projecting first region 64 which extends between two adjacent deep grooves 60, and which is more than twice as thick as a single bar 50. The first region 64, due to its thickness, does not present any problems of strength. Surmounting the first region, are two protruding narrower second regions 66, which are separated from one another by the shallow groove 56. The second regions 66 are less than half the width of the first region 64, but they are of a substantially smaller height, and thus, although narrow, are not so narrow for their height as to present a problem.

As shown in FIG. 2, the sector 31 has an arrangement of refiner bars 50 which is configured to provide the desired refining action required at different radial positions on the disk 28. The disk has generally three regions: an inner zone 68, an outer zone 70 of more closely spaced bars, and a transition zone 72 where the inner and outer zones meet. The depths of the shallow grooves 56 and the deep grooves 60 will preferably vary with position. At the inner diameter 29, as shown in FIG. 3, the difference in depth between the shallow and deep grooves will be at its minimum; for example, the shallow grooves may be eighty-one percent of the depth of the deep grooves. At the transition zone 72, the depth of the shallow grooves may decrease while the depth of the deep grooves remains constant, to a ratio of, for example, seventy-one percent between the depth of the shallow and the deep grooves. At the outer diameter 33, as shown in FIG. 5, the ratio may be fifty-seven percent. The depth of the deep grooves at the outer diameter may remain constant, or it may be decreased to increase the rigidity of the bars 50. The grooves 56, 60 may be formed to have gradually decreasing depth as they extend radially outwardly, or they may be formed to have step-like discontinuous changes in depth at zone changes.

Throughout the disk, the depth and/or the width of the grooves can be varied, as required for optimizing the refining and flow requirements for the specific application. For example, it may be advantageous to have the grooves flare outwardly, that is to gradually widen, toward the outer diameter, to increase the openness of the design.

Figure 7:
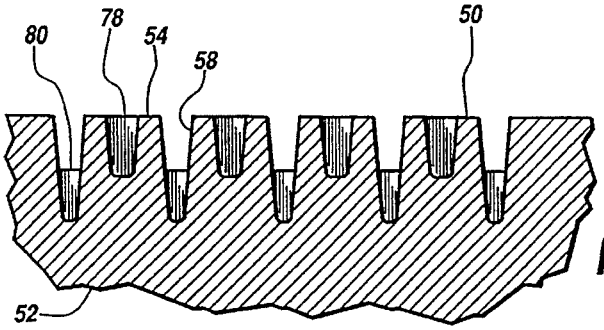
FIG. 7 is a cross-sectional view of the refiner disk of FIG. 2 showing subsurface dams positioned in the deep grooves and surface dams positioned in the shallow grooves.

As shown in FIG. 7, the refiner disk 28 is provided with an array of dams 78, 80, which have been omitted from the cross-sectional views of FIGS. 3–5 for clarity. It is important that the bar patterns of the refiner disk result in most fibers being brought to the bar surface where the desirable fraying of fibers can take place. Fibers which reside within a groove between bars and channel out the entire length of the disk without passing over the tops of the bars do not benefit from the refining processing. Fibers can be forced to the surface by positioning flow dams between neighboring bars. Dams 78, 80 are positioned between the bars 50 at a selected radial position. The dams 78 within the shallow grooves 56 are surface dams, which extend to the full height of the bars, the top surfaces of which may be coplanar. The dams 80 within the deep grooves 60 are subsurface dams, which extend to a level beneath the top surfaces of the bars 50. Dams of varying height may be positioned throughout the disk 28 at any radial position which design requirements warrant.

Computer-aided design techniques make the manufacture of disk patterns with varying depth and width grooves an economical undertaking. The manufacture of the refiner bars 50 is aided by the use of casting techniques which allow features of smaller dimension to be formed, such as those techniques which employ fine-grained sands with an organic binder rather than conventional green sand castings.

It should be noted that while the illustrated arrays of bars feature alternating deep and shallow grooves, any number of shallow grooves may be placed between neighboring deep grooves while preserving overall bar strength.

The refiner bars are preferably cast of white cast iron, stainless steel or other alloys combining the features of strength, wear resistance and cost-effectiveness.

It should also be understood that while the refiner bars of this invention are illustrated as arrayed in a certain pattern, the pattern of FIG. 6 is exemplary of refiner disk bar arrangements, and other appropriate patterns may also be employed.

It should be understood that the invention is not limited to the particular construction and arrangement of parts herein illustrated and described, but embraces such modified forms thereof as come within the scope of the following claims.

I claim:

1. A disk for rotation within a refiner for putting fiber source material into a condition for papermaking, the disk having a fiber refining area comprising:

a base member which extends radially about an axis;

two adjacent first refiner bars spaced from one another and protruding outwardly from a face of the base member, wherein a first groove of a first depth is defined between said first refiner bars substantially the length of said first refiner bars;

two second refiner bars protruding outwardly from said face of the base member, one of said second refiner bars being spaced from one of the first refiner bars substantially the length thereof, and the other of said second refiner bars being spaced from the other of the first refiner bars substantially the length thereof, and wherein second grooves of a second depth are defined between adjacent first and second bars substantially the length thereof, the second grooves having a depth substantially greater than the depth of the first groove throughout the refining area; and adjacent first refiner bars and adjacent first and second refiner bars being substantially equally spaced from each other.

2. The disk of claim 1 wherein said base member has an inner diameter and an outer diameter, pluralities of said first and second refiner bars are arranged in first and second arrays, having adjacent pairs of first bars being separated by a second bar, thereby defining alternating first grooves and second grooves between the bars, said first array being disposed in a first zone extending radially outwardly from the inner diameter, said second array being disposed in a second zone extending radially outwardly from said first zone, and said first grooves of said second array being shallower than said first grooves of said first array.

* * * * *